US007540156B2

(12) United States Patent
Brown et al.

(10) Patent No.: US 7,540,156 B2
(45) Date of Patent: Jun. 2, 2009

(54) COMBUSTION LINER FOR GAS TURBINE FORMED OF CAST NICKEL-BASED SUPERALLOY

(75) Inventors: Mark Roger Brown, Greenville, SC (US); Thomas Frank Fric, Greer, SC (US); Thomas Edward Johnson, Greer, SC (US); Anne Elizabeth Kolman, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 572 days.

(21) Appl. No.: 11/285,327

(22) Filed: Nov. 21, 2005

(65) Prior Publication Data

US 2007/0113558 A1 May 24, 2007

(51) Int. Cl.
*F23R 3/42* (2006.01)

(52) U.S. Cl. ..... 60/752; 431/356

(58) Field of Classification Search ..... 60/722, 60/752, 796; 431/353, 356
See application file for complete search history.

(56) References Cited

U.S. PATENT DOCUMENTS

| | | | | |
|---|---|---|---|---|
| 3,527,285 | A * | 9/1970 | Webbere | 164/114 |
| 4,236,378 | A * | 12/1980 | Vogt | 60/757 |
| 5,335,502 | A * | 8/1994 | Roberts et al. | 60/752 |
| 6,416,596 | B1 | 7/2002 | Wood et al. | |
| 6,428,637 | B1 | 8/2002 | Wood et al. | |
| 6,553,767 | B2 * | 4/2003 | Farmer et al. | 60/752 |
| 2004/0079083 | A1 * | 4/2004 | Stumpf et al. | 60/752 |

FOREIGN PATENT DOCUMENTS

| | | | |
|---|---|---|---|
| WO | WO 99/06771 | * | 2/1999 |

* cited by examiner

*Primary Examiner*—Louis J Casaregola
(74) *Attorney, Agent, or Firm*—Cantor Colburn LLP

(57) ABSTRACT

A combustion liner for a gas turbine combustion system is provided. The combustion liner comprises a combustion zone between an inlet end and an exhaust end. The combustion liner comprises a one-piece casting construction. The combustion liner is formed from a nickel-based superalloy having strength characteristics.

6 Claims, 5 Drawing Sheets

COMBUSTION LINER FOR GAS TURBINE FORMED OF CAST NICKEL-BASED SUPERALLOY

BACKGROUND

This disclosure relates to combustion chambers in gas turbine engines. In particular, the invention relates to materials for hot gas path parts, such as, but not limited to, combustion liners within the combustion chambers of gas turbines.

The combustion system of a gas turbine generates hot gases. The hot gases can be utilized to drive a turbine. The turbine, in turn, can drive a compressor, wherein the compressor provides compressed air for combustion in the combustion system. Additionally, the turbine produces usable output power, which can be connected directly to power-consuming machinery or to a generator.

The combustion system for a gas turbine may be configured as a circular array of combustion chambers. The combustion chambers are arranged to receive compressed air from the compressor, inject fuel into the compressed air to create a combustion reaction, and generate hot combustion gases for the turbine. The combustion chambers are generally cylindrically shaped, however other shapes of combustion chambers are possible. Each combustion chamber comprises one or more fuel nozzles, a combustion zone within the combustion liner, a flow sleeve surrounding and radially spaced from the liner, and a gas transition duct between the combustion chamber and turbine.

The combustion zone defines a volume within the combustion liner in which a fuel/air mixture combusts to generate the hot gases. Accordingly, compressed air flows from the compressor to the combustion zone through an annular gap provided between the combustion liner and flow sleeve. Air flowing through this gap can act to cool the outer surface of the liner. The compressor air then can flow into the combustion zone through at least one of the fuel nozzles and holes in the combustion liner. Compressor air can also flow between the liner and flow sleeve in a first direction, can reverse direction as it enters the combustion liner, and can flow as a hot gas out of the liner and combustor, and then into the turbine.

The combustion liner typically operates in a high temperature environment, in which a combustion process generates a stream of high-velocity hot gases that flow through the liner and to the turbine. The combustion liner should be mounted in the flow sleeve to withstand the heat as well, as vibration. Further, the combustion liner should be mounted to withstand loads imposed by the combustion of gases and other forces that act on the combustion chamber.

Large gas turbine combustor components have traditionally been fabricated with superalloys, such as, but not limited to, wrought nickel-based superalloys. As turbine designs evolved for operation at higher temperatures, superior low cycle fatigue, oxidation and creep properties of cast superalloys were desired. Also, multiple cast pieces subsequently were joined to turbine combustor components by metallurgical connecting means, such as but not limited to, brazing or welding. However, these means, such as but not limited to, brazing or welding have not lead to an acceptable outcome since the joint locations did not have the material properties of the remainder of the turbine combustor components. Accordingly, a need for turbine combustor components with connected cast pieces is desired where the connected cast pieces have similar material properties as the turbine combustor components as well as at the means for connecting the connected cast pieces to the turbine combustor components.

Transition pieces have been provided formed from various materials. For example, some transition pieces have been formed with a cast alloy, such as GTD-222, as described in U.S. Pat. No. 6,416,596 granted to Wood et al., and U.S. Pat. No. 6,428,637 granted to Wood et al.). These materials have provided improvement in material properties, such as but not limited to at least one of low cycle fatigue (LCF) resistance and creep strength vs. wrought alloys, manufacturability, machinability, weldability, and oxidation resistance, in turbine combustor components, for example hot gas path parts. These improvements are especially evident with respect to wrought alloy material properties. However, for some high temperature turbine applications, increased material characteristics, such as strength, would provide desirable life potentials. Therefore, there exists a desire to provide turbine combustor components with materials that provides enhanced strength and possible extended turbine life.

BRIEF DESCRIPTION

In one embodiment, a combustion liner for a gas turbine combustion system is provided. The combustion liner comprises a combustion zone between an inlet end and an exhaust end. The combustion liner comprises a one-piece casting construction. The combustion liner is formed from a nickel-based superalloy having strength characteristics.

These and other features will become apparent from the following detailed description, which, when taken in conjunction with the annexed drawings, where like parts are designated by like reference characters throughout the drawings, and disclose embodiments.

DETAILED DESCRIPTION OF THE INVENTION

Figure 1:
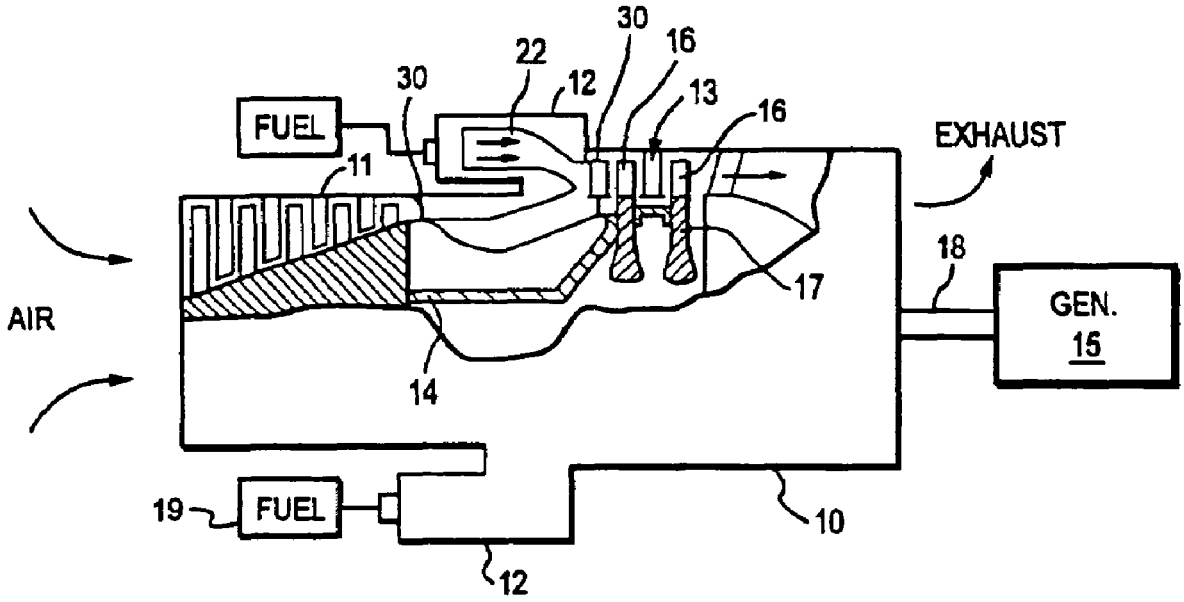
FIG. 1 illustrates an exemplary gas turbine comprising a combustion system, with a section of the turbine being cutaway to illustrate internal components of the gas turbine.

The gas turbine engine 10, depicted in FIG. 1, includes a compressor 11, combustion system 12, and a gas turbine 13. The compressor 11, combustion system 12, and turbine 13 are disposed about to at least one of rotatable shaft 14. Atmospheric air enters the gas turbine 13 to be pressurized, heated and expelled to provide usable power output. The output power can be provided to a power-driven machine or an associated power-generating machine, such as, but not limited to, an electric generator 15. The specification will refer to an electric generator 15, however this description is not intended to limit the scope of this application and claims in any manner. It is merely exemplary of the power-driven machine.

The compressor 11 provides pressurized air to the combustion system 12. Fuel is provided to the combustion system 12 from a fuel system 19. The fuel can be mixed with pressurized air in a combustion chamber 20 to generate combustion gases and heat energy. The combustion gases can be flow away from the combustion chamber 20 to the turbine 13. The combustion gases flow through an annular array(s) of turbine blades 16, which are mounted on disks 17. These disks 17 rotate with a respective shaft 14. The rotation of each shaft 14 turns the compressor 11, which in turn compresses the air to feed the combustion process. Also, rotation of the shaft 14 can also provide a power output 18 from the gas turbine 13 to the generator 15 or other system.

Figure 2:
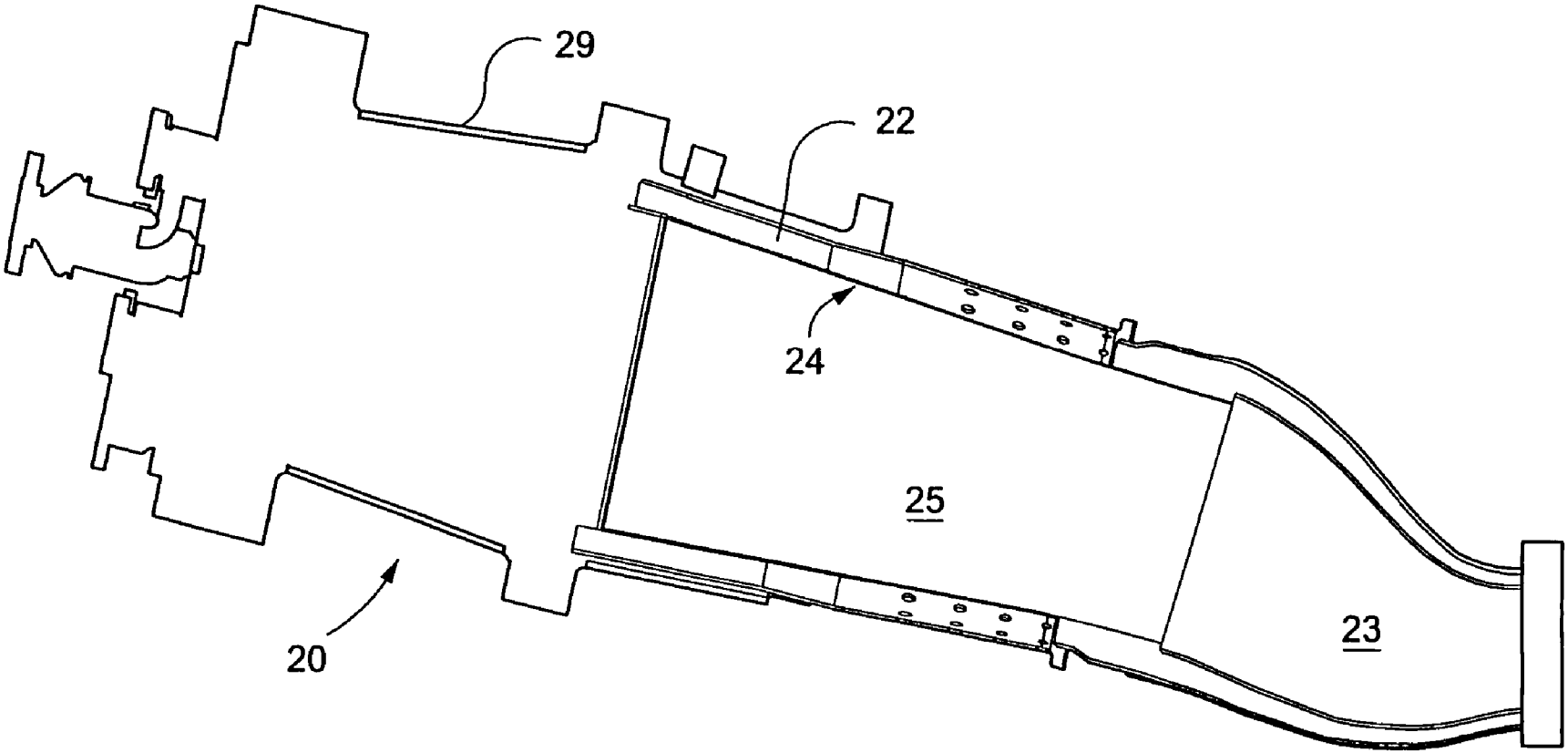
FIG. 2 illustrates a schematic cross-sectional view of an exemplary gas turbine combustion system, including the combustion liner.

FIG. 2 illustrates one embodiment of combustion chamber 20, which comprises part of the circular array of combustion chambers 20. These combustion chambers 20 are disposed around the center of the gas turbine 13 that is included in the combustion system 12.

The combustion chamber 20 comprises a compressed air inlet duct, a flow sleeve 22, and combustion gas exhaust duct or transition piece 23 to direct combustion air to the turbine. The flow sleeve 22 houses a combustion liner 24, and in turn the combustion liner 24 defines a combustion zone 25.

Further, a combustion casing 29 is provided in the combustion system and houses each of the combustion chambers 22. The combustion casing 29 attaches a combustion chamber 22 to a housing 30 of the gas turbine, as illustrated in FIG. 1. The combustion liner 24 is coaxially mounted within the flow sleeve 22. The combustion liner 24 and flow sleeve 22 are both coaxially mounted within the combustor casing 29. The flow sleeve 22 is mounted in the combustion casing 29 by any appropriate means, such as, but not limited to, mounting brackets.

The combustion liner 24 comprises a generally conical configuration having an inlet end that is generally aligned with a fuel nozzle. The combustion liner 24 also defines an exhaust end. The exhaust end is coupled to the transition piece 23 define a flow passage for combustion gases from the combustion system.

The combustion liner 24 can be formed via a casting process in a one-piece or unitary construction. Thus the one-piece or unitary construction does not comprise metallurgical connecting means, such as but not limited to, brazing or welding, as evident in known combustion liner configurations. In other words, combustion liner 24 is not assembled from two or more components or parts, it is a single part. The combustion liner 24 can be formed from a nickel-based superalloy material. The superalloy material should provide sufficient material characteristics for operation at desired turbine operating conditions. These material properties include, but are not limited to, enhanced low cycle fatigue (LCF), enhanced resistance and creep strength vs. wrought alloys, enhanced manufacturability, improved machinability, enhanced weldability, and enhanced oxidation resistance. A nickel-based superalloy that provides such material characteristics is Udimet alloy 500, which conforms with UNS N07500. This alloy is merely exemplary of a material that provides the desired material properties. The composition of Udimet alloy 500 is provided in Table 1.

TABLE 1

| Composition of Udimet 500 | |
|---|---|
| Carbon | 0.15 max. |
| Aluminum | 2.50-3.25 |
| Titanium | 2.50-3.25 |
| Molybdenum | 3.00-5.00 |
| Chromium | 15.00-20.00 |
| Cobalt | 13.00-20.00 |
| Iron | 4.00 max. |
| Silicon | 0.75 max. |
| Manganese | 0.75 max. |

TABLE 1-continued

| Composition of Udimet 500 | |
|---|---|
| Sulphur | 0.015 max. |
| Nickel | Remainder |

As discussed, the material of the combustion liner 24 is chosen to provide LCF resistance and creep strength vs. wrought alloys, manufacturability, machinability, weldability, oxidation resistance. The LCF resistance and creep strength vs. wrought alloys, manufacturability, machinability, weldability, oxidation resistance are provided to extend life intervals of the material, where the life can be enhanced or extended by any amount of time. The nickel-based superalloy possesses strength characteristics at least conforming with if not greater than at least one of Udimet alloy 500 and UNS N07500.

As embodied by the invention, the combustion liner 24 can be formed with a ratio of wall thickness to liner diameter in a range between about 0.006 to about 0.013. For example, the combustion liner 24 can be formed with a ratio of wall thickness to liner diameter of about 0.125:17.

Prior attempts to produce large cast objects with thin walls have not been overly successful. In prior casting attempts problems arose for example, but limiting, when molten material cools too quickly in the mold due to thinner formed walls, thus resulting in a product that may not have desirable products for a hot gas path part. However the desired the combustion liner 24 with the ratio of wall thickness to liner diameter, as noted above can be provided by temperature controlled casting processes. One such temperature controlled casting processes is "Thermally Controlled Solidification" (TCS), which is performed by Precision Castparts Corporation (PCC) of Portland, Oreg.

Additionally, the combustion liner 24 can comprise component hardware or pieces that were previously welded or otherwise connected. These component hardware or pieces are cast integrally with the combustion liner 24. Thus, the component hardware comprises multiple cast pieces integrally formed with the combustion liner 24, without need for such component hardware being joined to turbine combustor components by metallurgical connecting means, such as but not limited to, brazing or welding. Accordingly, the combustion liner 24 does not include locations between the combustion liner 24 and the component hardware/pieces where the material properties differ from the remainder of the combustion liner. The combustion liner 24 can then be formed as a unitary article with integrally cast and connected hardware pieces, where these connected hardware pieces have similar material properties as the turbine combustor components as well as similar material properties at points where the connected cast pieces are attached to the combustor liner.

Figure 3:
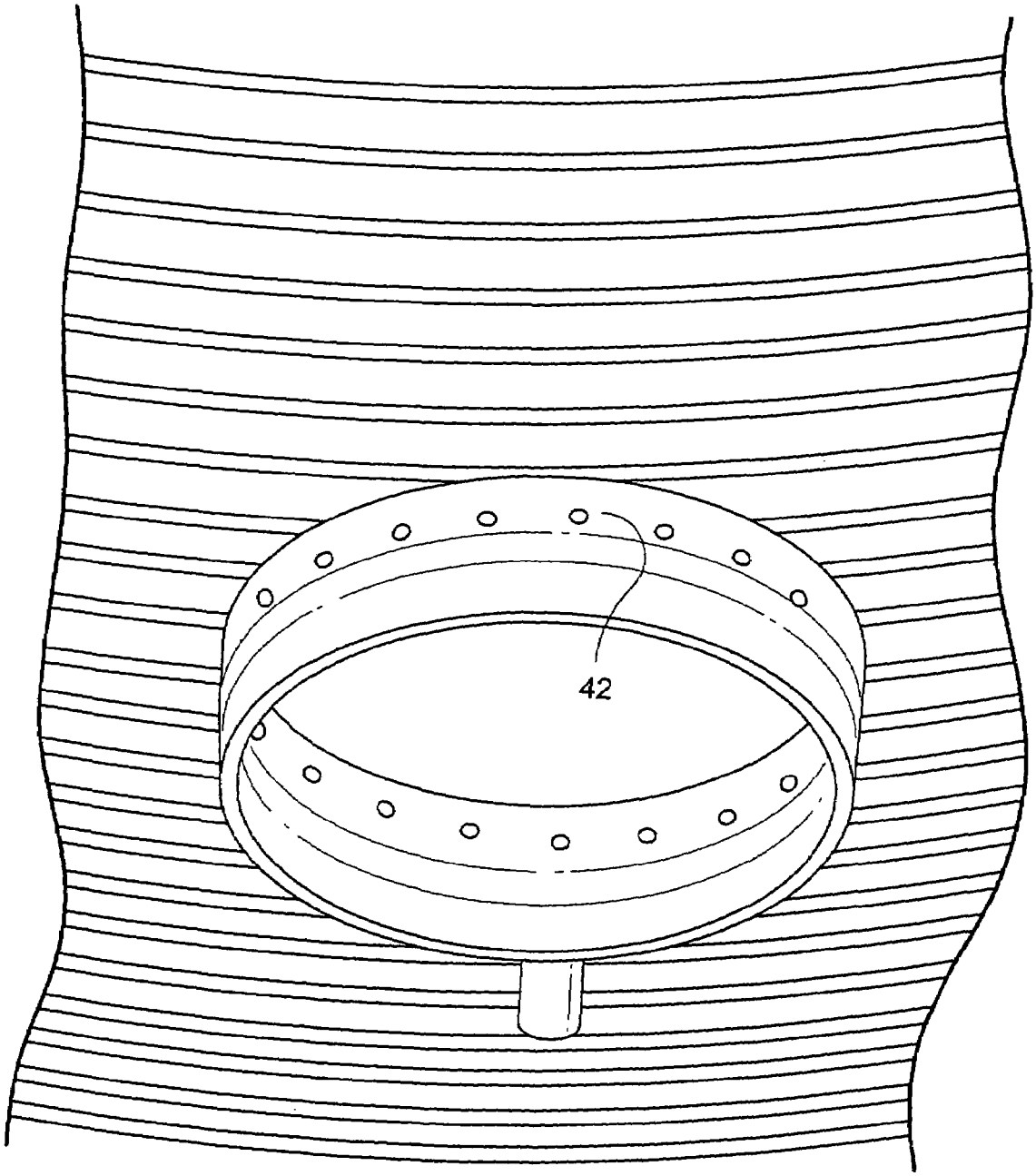
FIG. 3 illustrates an exemplary combustion liner, with integral turbulators.

The component hardware/pieces of the combustor liner 24 may comprise heat transfer enhancing component(s). These heat transfer enhancing components may comprise any suitable structure for heat transfer in the combustion liner 24, such as, but not limited to, turbulator(s). FIG. 3 illustrates one configuration of turbulators 42, as embodied by the invention. Alternatively or in addition to the heat transfer enhancing components, as illustrated in FIG. 4, the component hardware of the combustion liner 24 may include other component(s).

These other components include components that are cast with the combustion liner 24 and are cast in a form that is very close to the desired final shape. These other components are known as "near net shape components" require very little or no subsequent machining, after initial casting. Accordingly, by forming these other components to near "net" or final shape, little after casting processing is needed. Therefore, enhanced production of a combustion liner 24 or other turbine component can be achieved. For example, and in no way limiting of the invention, production of the combustion liner 24 can be enhanced by reducing cost, finishing machining required, and other post-casting processes.

Figure 4:
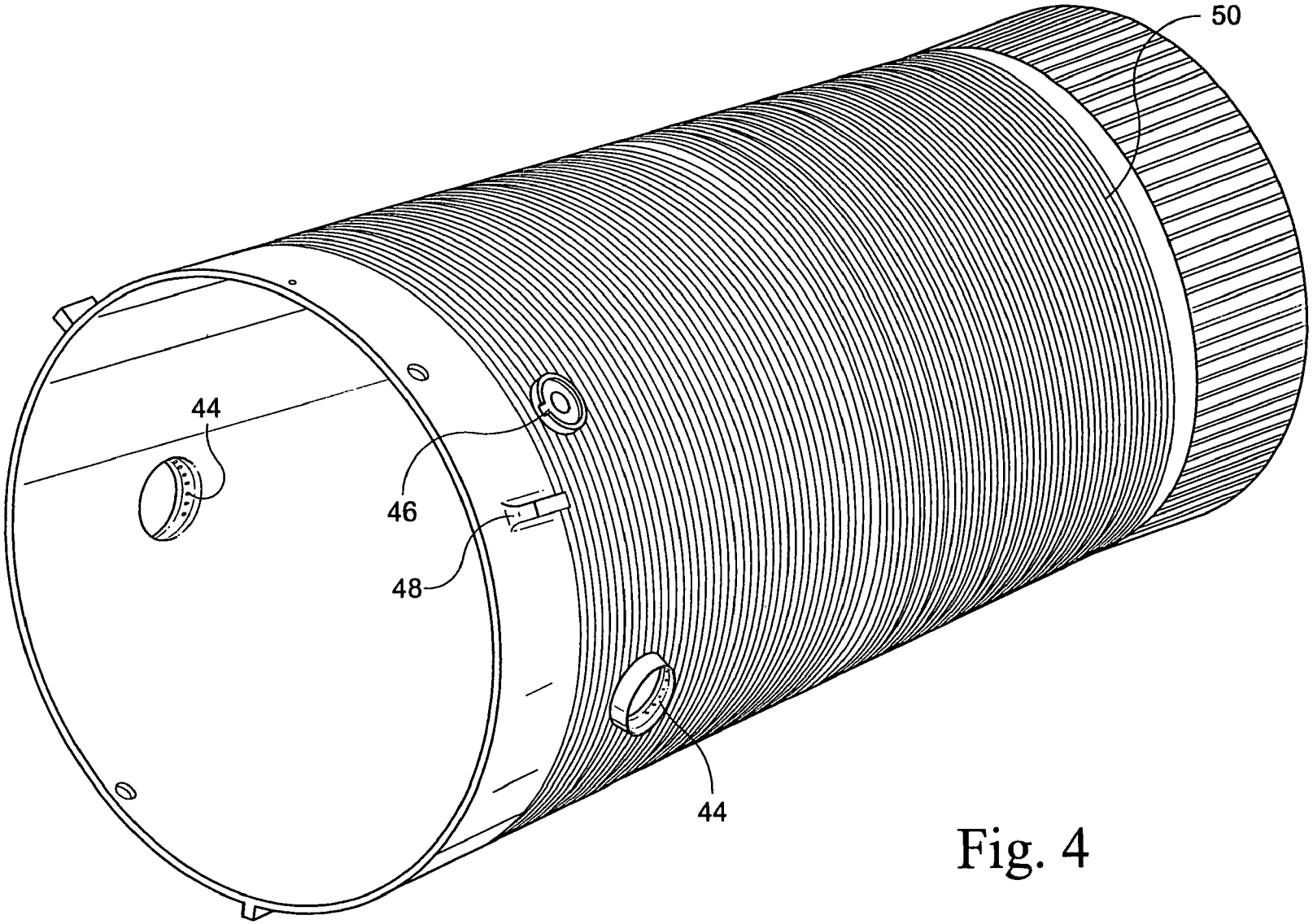
FIG. 4 illustrates a schematic illustration of an exemplary combustion liner, including near net shaped cast features.

Examples of such components, other than turbulators, that are cast with the combustion liner 24 and cast in a form that is very close to the desired final shape are illustrated in FIG. 4. These illustrations are merely exemplary of the components within the scope of the invention and are not intended to limit the invention in any manner. FIG. 4 illustrates some other components include bosses 44, collars 46, and liner stops 48. Further, a vari-cool passage 50 facilitates air cooling of the combustion liner aft end.

As noted above, the material for the combustion liner 24 provides enhanced low cycle fatigue (LCF), enhanced resistance and creep strength, improved manufacturability, better machinability, enhanced weldability, and desirable oxidation resistance cost. Other cast nickel based gamma prime strengthened alloys are also viable candidates generally having strength characteristics that match or exceed those of Udimet alloy 500. "Strength characteristics" herein includes at least LCF resistance, creep strength, yield strength and ultimate tensile strength, each of which can be determined using well-known tests. With the structure of the turbine creep, low cycle fatigue, and oxidation properties were improved.

Figure 5:
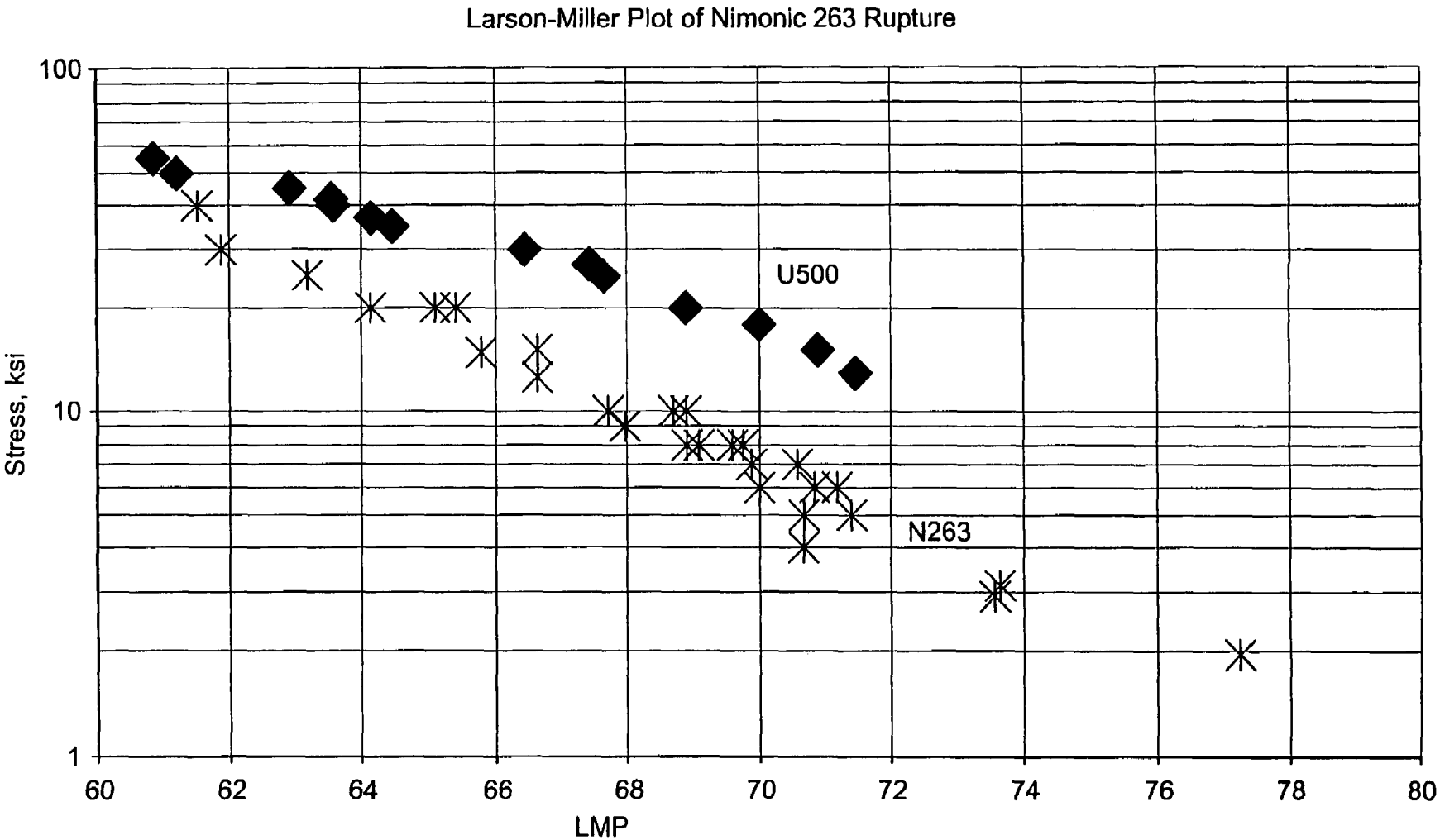
FIG. 5 illustrates creep strength improvement with Udimet alloy 500 over a nickel based wrought alloy, Nimonic 263.

FIG. 5 illustrates improvement in creep capability of an article formed of Udimet 500 versus Nimonic 263, a nickel based wrought alloy. For a given test strain level, article formed from the cast nickel based superalloy achieved higher Larson Miller Parameters before failure. These results indicate that more time and/or higher temperatures were required to induce specimen failure, and longer time before failure and use at higher temperatures are desirable properties of turbine combustion systems.

With the structure and method of combustion liner formation a single-piece/unitary combustion liner can be cast produced with desirable and enhanced mechanical properties. Therefore, the combustion liner can provide longer component life. This longer component life can be attributed, at least in part, to the improved low-cycle fatigue, creep and oxidation properties of the material. Moreover, a single-piece cast configuration of a combustion liner enables other combustion liner features, which are normally attached by joining processes, to be formed by integral casting. Thus, costs and post-casting machining can be reduced, and the turbine liner can have improved integrity by eliminating weaker joints evident in prior welding of combustion liner features.

It is noted that the terms "first," "second," and the like, as well as "primary," "secondary," and the like, herein do not denote any amount, order, or importance, but rather are used to distinguish one element from another, and the terms "a" and "an" herein do not denote a limitation of quantity, but rather denote the presence of at least one of the referenced item. As used herein the term "about", when used in conjunction with a number in a numerical range, is defined being as within one standard deviation of the number "about" modifies. The suffix "(s)" as used herein is intended to include both the singular and the plural of the term that it modifies, thereby including one or more of that term (e.g., the bearings(s) includes one or more bearings).

While various embodiments are described herein, it will be appreciated from the specification that various combinations of elements, variations or improvements therein may be made by those skilled in the art, and are within the scope of the invention.

What is claimed is:

1. A combustion liner for a gas turbine combustion system, the combustion liner comprising:

a combustion zone between an inlet end and an exhaust end, wherein the combustion liner comprises a one-piece casting construction, the combustion liner being formed from a nickel-based superalloy, the nickel-based superalloy having strength characteristics at least conforming with if not greater than at least one of Udimet alloy 500 and UNS N07500,and wherein a ratio of wall thickness to liner diameter is about 0.125:17.

2. A combustion liner according to claim 1, wherein the combustion liner comprises component hardware, the component hardware comprising component hardware that is integrally cast with the combustion liner.

3. A combustion liner according to claim 2, wherein the component hardware comprises heat transfer enhancing components.

4. A combustion liner according to claim 3, wherein the heat transfer enhancing components comprise turbulators.

5. A combustion liner according to claim 2, wherein the component hardware comprises near net shape components.

6. A combustion liner according to claim 5, wherein the near net shape components comprise at least one of bosses, collars, and liner stops.

* * * * *